US006096667A

United States Patent [19]

Rhode

[11] Patent Number: 6,096,667

[45] Date of Patent: Aug. 1, 2000

[54] HOOK AND LOOP FASTENER

[75] Inventor: Werner Rhode, Greenville, S.C.

[73] Assignee: Milliken & Company, Spartanburg, S.C.

[21] Appl. No.: 08/279,557

[22] Filed: Jul. 25, 1994

[51] Int. Cl.[7] ..... A44B 18/00; D04B 21/02

[52] U.S. Cl. ..... 442/313; 24/444; 24/446; 24/450; 428/89; 428/96; 66/192; 66/194

[58] Field of Search ..... 428/85, 89, 92, 428/93, 96, 253, 254; 66/190, 161, 192, 193, 194, 195; 24/442, 444, 445, 446, 450; 442/313

[56] References Cited

U.S. PATENT DOCUMENTS 4,624,116 11/1986 Rogers ..... 66/193
4,705,710 11/1987 Matsuda ..... 428/92
4,709,562 12/1987 Matsuda ..... 66/193
4,714,096 12/1987 Guay ..... 139/391
4,838,044 6/1989 Matsuda et al. ..... 66/190
5,119,643 6/1992 Conley et al. ..... 66/190
5,125,246 6/1992 Shytles ..... 66/193
5,214,942 6/1993 Peake, III et al. ..... 66/194
5,267,453 12/1993 Peake, III et al. ..... 66/194

*Primary Examiner*—Marie Yamnitzky
*Attorney, Agent, or Firm*—Terry T. Moyer; Earle R. Marden

[57] ABSTRACT

A warp knit, weft inserted lap side loop pile fabric for use as a female connector in a hook and loop fastener in which adjacent loops in each wale alternate from one direction to the other. If desired the back of the fabric can be coated to provide strength and rigidity to the fabric.

20 Claims, 3 Drawing Sheets

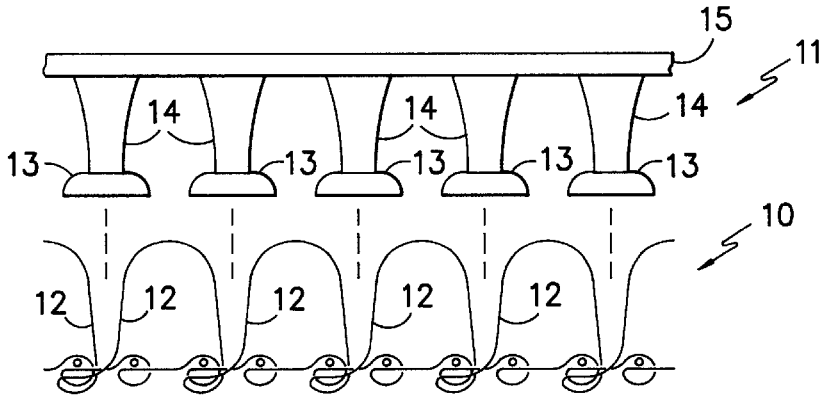
FIG. –1–
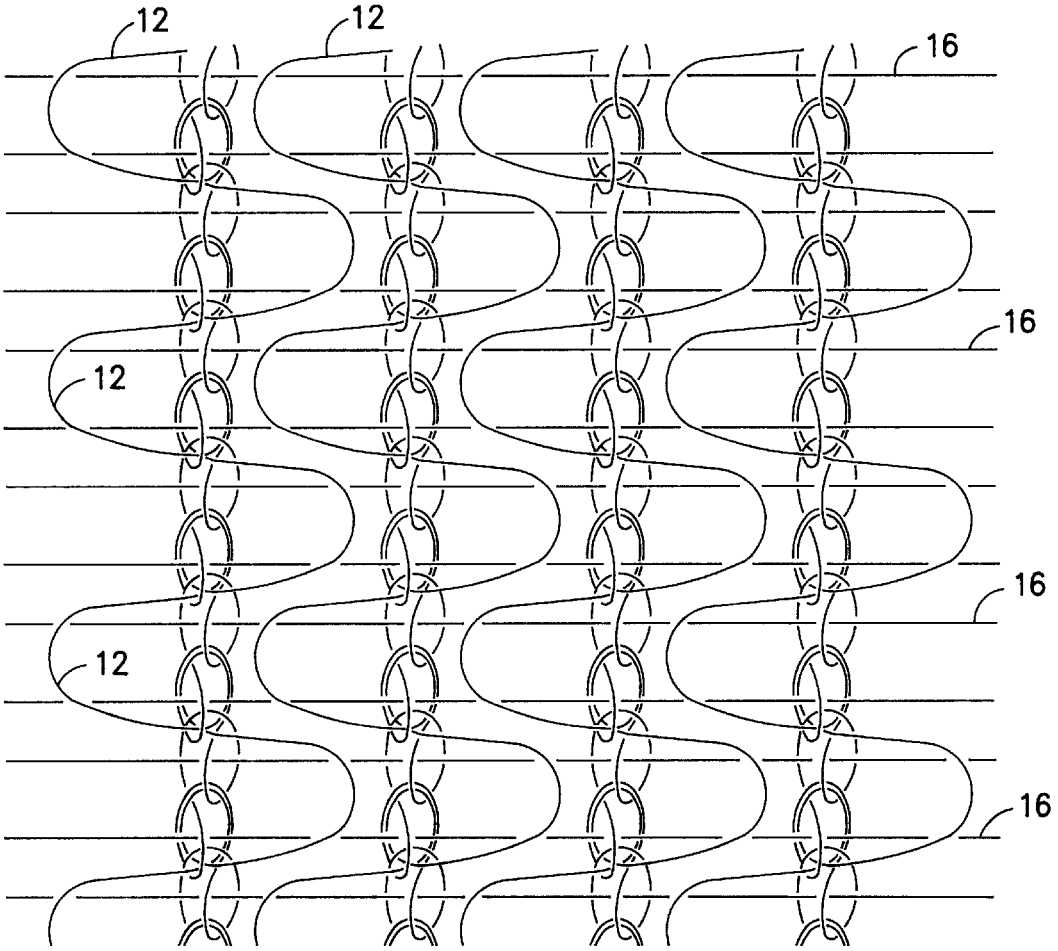
FIG. –2–

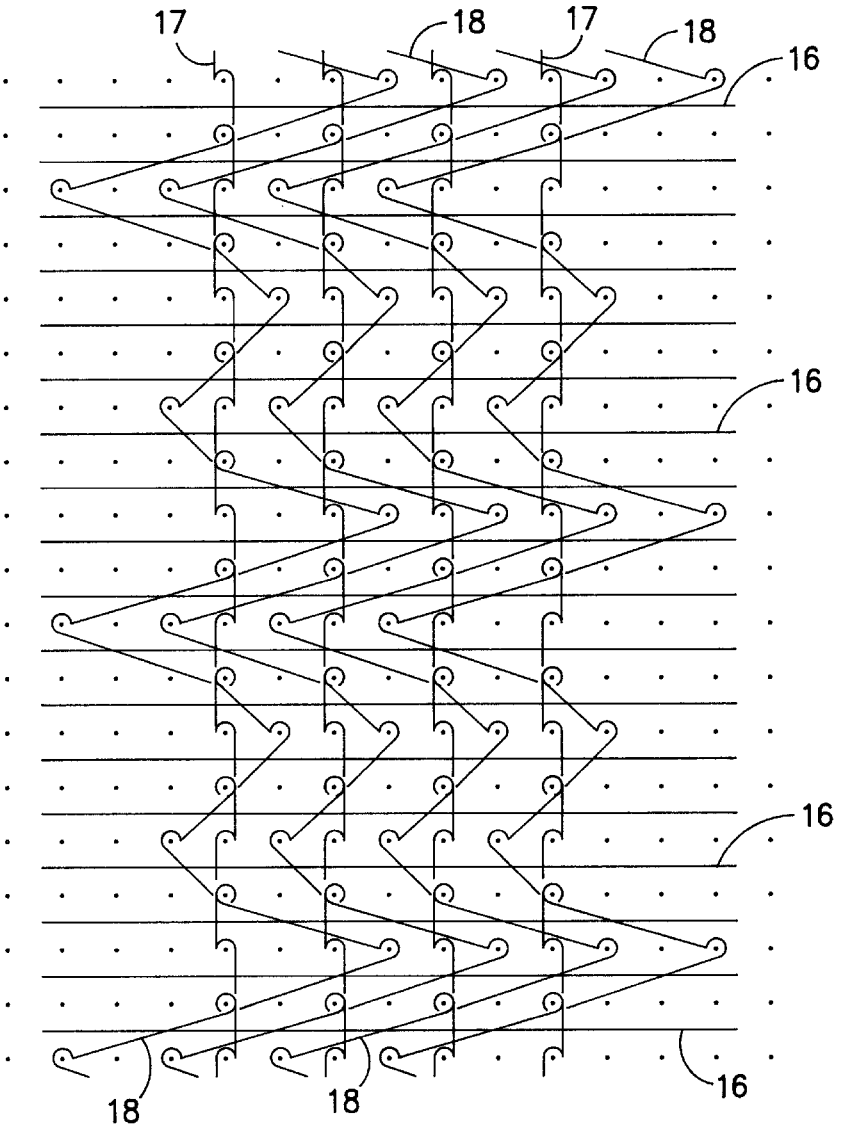
FIG. –5–
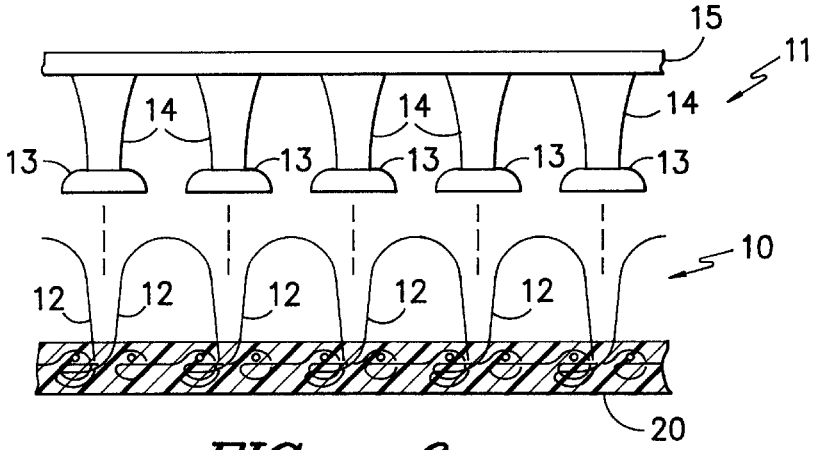
FIG. –6–

HOOK AND LOOP FASTENER

This invention relates generally to a warp knit, weft inserted fabric which can be employed as the female fabric for securing an article of manufacturing in a preselected position which may or may not have a coated backing for strength and rigidity.

Therefore, it is an object of the invention to provide a warp knit, weft inserted lap side loop pile fabric which can be employed as the female member of a securing means.

Other objects and advantages of the invention will be come readily apparent as the specification proceeds to describe the invention with reference to the accompanying drawings, in which:

FIG. 1 is a schematic representation of the hook fasteners in relation to the novel loop pile fabric;

FIG. 2 is the top view of the lap (technical back) side of the novel warp knit fabric;

FIG. 5 is a point diagram of the guide bars showing a still further modification;

FIG. 6 is a view similar to FIG. 1 showing the female fabric member coated with a strengthening material.

Figure 3:
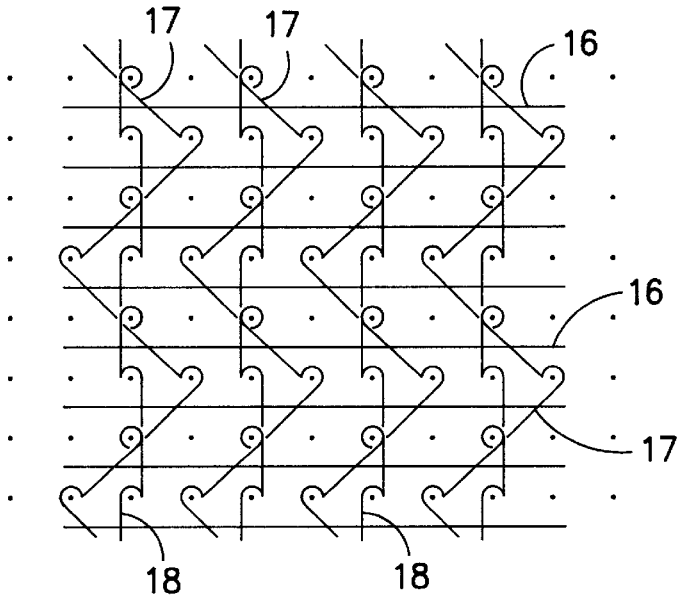
FIG. 3 is a point diagram of the action of the guide bars of the knitting machine.

Looking now to FIG. 1, the new and improved fabric 10 will upstanding loops 12 are shown in position where they can be engaged by the hook member 11 which consists of the hooks 14 connected to a support member 15. In practice, the fabric 10 would be connected to a supporting structure (not shown) so that when the article to be secured in a fixed position, to which the hook member 11 is attached, as projected towards the loops 12, the hooks 14 will engage same and be secured therein. The hook member 11 is not, per se, a part of the invention and can be any suitable type, such as that formed by the molding or casting of nylon to form the desired configuration shown in FIG. 1.

The substrate fabric 10, as represented in FIGS. 1–5, is a warp knit, weft inserted fabric knit on a two-bar, weft insertion warp knitting machine. As indicated in FIGS. 1 and 2, the loops 12 are lap loops formed by the front bar of the knitting machine while each of the weft inserted yarn 16 are held therein substantially parallel to one another by and between the chain stitch wales 18 formed by the back bar. The weft yarn 16 is preferably 70 denier textured polyester but can be in the range of 40–150 denier. The fabric 10 thereby presents a surface of loops 12 which can be readily manufactured on a warp knitting machine and at the same time provides added strength due to the insertion of the weft yarn 16. The loops 12, as shown in FIG. 1, are free loops in the sense that they are open and project freely upward and are connected only at the base to their respective wale.

It should be noted that the free loops in each wale alternate from one direction to the other along the wale (e.g. in FIG. 2, one loop is to the left and the next adjacent loop in the same wale is to the right). Also the loops in each wale are shifted in the same direction as the loop in the next adjacent wales. This shifting of the loops 12 provides for a more secure and positive engagement of the loops 12 by the grasping portion 13 of the hook member 11 of the male interconnecting member.

FIGS. 1–3 show one form of the novel fabric constructed with the pattern wheel for the front bar 70 denier textured polyester yarn set to knit a 3-2, 1-2, 0-1, 2-1 stitch 17 and the pattern wheel for the back bar 150 denier polyester yarn set to knit a 1-0, 0-1, 0-1, 1-0 chain stitch. The weft inserted filling yarn 16 is a 150 denier polyester 10 yarn. This form of the fabric provides a lap side loop the height of which is slightly less than the spacing between adjacent wales of the chain stitch yarn 18.

Figure 4:
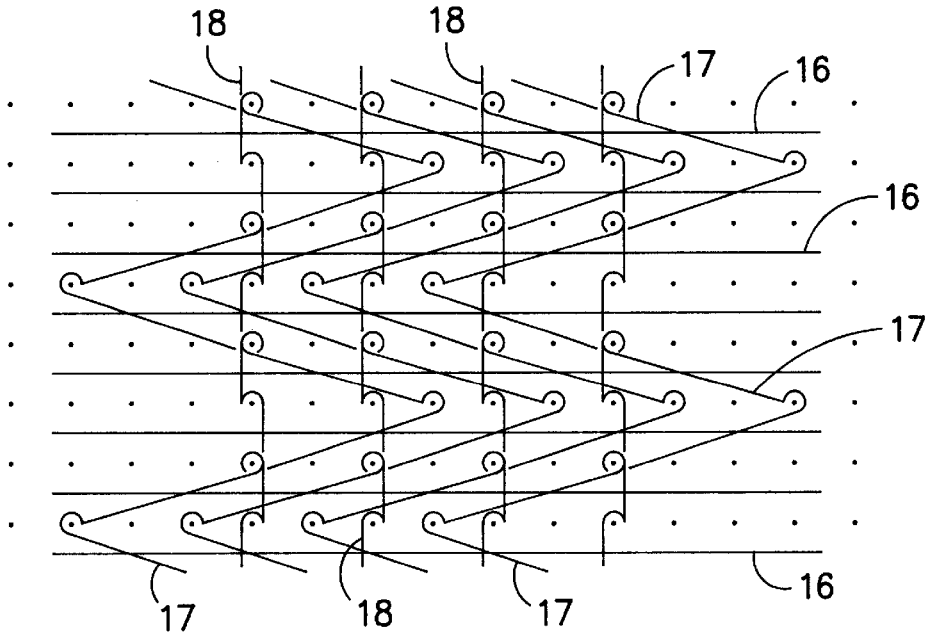
FIG. 4 is a point diagram of the guide bars of the knitting machine to produce a modification of FIGS. 1–3.

If it is desired to provide a fabric with a longer lap side loop, the construction shown in FIG. 4 can be employed with the pattern wheel for the front bar set to knit a 3-4, 0-1, 4-3, 7-6 stitch and the pattern wheel for the back bar set to knit a 1-0, 0-1, 0-1, 1-0 chain stitch. In the form of the invention the lap loop 12 for engagement by the hooks 14 will have a potential height greater than the distance between adjacent wales in the fabric.

FIG. 5 illustrates a fabric which has a set of large loops to the left and right side followed by a set of short loops. The pattern wheel for the front bar is to knit 3-4, 2-3, 4-3, 7-6, 3-4, 0-1, 4-3, 5-4 and the back bar to knit 1-0, 0-1, 0-1, 1-0. As in the above embodiments the front bar yarn is 70 denier textured polyester and the back bar yarn is 150 denier flat polyester yarn. The front bar yarn can be in the range of 70–150 denier and the back bar yarn can be in the range of 40–150 denier.

FIG. 6 shows the basic substrate fabric 10 coated with an acrylic latex foam with the bubbles broken after coating. The acrylic latex is placed on the fabric in a foam condition and the bubbles are then broken with a knife. After the bubbles are broken, the acrylic latex is set by the application of heat. This provides strength and rigidity to the substrate so that it can readily be handled and has a longer service life. Other coating materials such as polyurethane, polyethylene and P.V.C. plastisol can be, among others, used to provide strength for the female fabric of the invention.

It can readily be seen that a knit fabric has been disclosed which can readily function as the female member of a hook and loop connection and which does not readily tear due to the weft inserted yarn that provides stability in the weft direction of the fabric.

Although I have described in detail the specific embodiments of the invention, it is contemplated that changes may be made without departing from the scope or spirit of the invention and I desire to be limited only by the claims:

I claim:

1. A weft inserted warp knit fabric for use as the female fabric in a hook and loop fastener comprising: a weft inserted warp knit fabric having a face side and a back side, said back side of said fabric having a plurality of spaced wales of stitches with a lap portion of each of said stitches projecting outwardly therefrom to form a free loop connected only at its base to its respective wale with adjacent loops in each wale tilted sidewise alternately in opposite directions and a weft yarn inserted into the courses of the fabric between the face and back side of the fabric and extending across the full width of the fabric.

2. The fabric of claim 1 wherein said loops are polyester yarn.

3. The fabric of claim 2 wherein said polyester yarns are textured.

4. The fabric of claim 3 wherein said weft inserted yarn is textured polyester.

5. The fabric of claim 4 wherein the face of said knit fabric is coated to provide strength thereto.

6. The fabric of claim 1 wherein a set of loops on one side of said wales is bigger than a set of loops on the opposite side of said wales.

7. The fabric of claim 1 wherein said face side stitches are chain stitches knit with a pattern of 1-0, 0-1, 0-1, 1-0.

8. The fabric of claim 7 wherein said back side loops are formed with a knit pattern of 3-2, 1-2, 0-1, 2-1.

9. The fabric of claim 7 wherein said back side loops are formed by a stitch pattern of 3-4, 0-1, 4-3, 7-6.

10. The fabric of claim 1 wherein said fabric is a two bar fabric with the face side being knit with a pattern of 1-0, 0-1, 0-1, 1-0 and the back side loops formed by a stitch pattern of 3-4, 2-3, 4-3, 7-6, 3-4, 0-1, 4-3, 5-4.

11. The fabric of any of the claims 7–10 wherein the face side of the fabric is coated to provide rigidity thereto.

12. An interlocking, readily separable closure member comprising a male member having a plurality of loop engaging members on one side thereof and a female member having a plurality of loops upstanding therefrom engaged by said engaging members, said female member being a weft inserted warp knit fabric having a face side and a back side, said back side of said fabric having a plurality of spaced wales of stitches with a lap portion of each of said stitches projecting outwardly therefrom to form a free loop connected only at its base to its respective wale with adjacent loops in each wale tilted sidewise alternately in opposite directions and a weft yarn inserted into the courses of the fabric between the face and back side of the fabric and extending across the full width of the fabric.

13. The closure member of claim 12 wherein said face side wales are chain stitches.

14. The closure member of claim 13 wherein said loops are polyester yarn.

15. The closure member of claim 14 wherein said polyester yarns are textured.

16. The closure member of claim 15 wherein the face of said knit fabric is coated to provide strength thereto.

17. The closure member of claim 12 wherein a set of loops on one side of said wales is bigger than a set of loops on the opposite side of said wales.

18. The closure member of claim 17 wherein said face side stitches are chain stitches knit with a pattern of 1-0, 0-1, 0-1, 1-0.

19. The closure member of claim 18 wherein said back side loops are formed with a knit pattern of 3-2, 1-2, 0-1, 2-1.

20. The closure member of claim 12 wherein said back side loops are formed by a stitch pattern of 3-4, 0-1, 4-3, 7-6.

* * * * *